US006761504B1

(12) United States Patent
Brandenberger et al.

(10) Patent No.: US 6,761,504 B1
(45) Date of Patent: Jul. 13, 2004

(54) WATERPROOF CLADDING CONSTRUCTION AND METHOD OF PROVIDING THE SAME

(75) Inventors: Rolf Brandenberger, Oberengstringen (CH); Knut Finn Garshol, Tomter (NO); Tom Arild Melbye, Wettswil (CH); Peter Alexander Schubert, Anthering (AT)

(73) Assignee: MBT Holding AG, Zurich (CH)

( * ) Notice: Subject to any disclaimer, the term of this patent is extended or adjusted under 35 U.S.C. 154(b) by 0 days.

(21) Appl. No.: 09/508,229

(22) PCT Filed: Jun. 24, 1999

(86) PCT No.: PCT/EP99/04407

§ 371 (c)(1),
(2), (4) Date: Apr. 20, 2000

(87) PCT Pub. No.: WO00/05487

PCT Pub. Date: Feb. 3, 2000

(30) Foreign Application Priority Data

Jul. 20, 1998 (GB) ..... 981 56 85

(51) Int. Cl.[7] ..... E21D 11/10
(52) U.S. Cl. ..... 405/150.2; 405/150.1
(58) Field of Search ..... 405/150.2, 150.1, 405/146, 151, 266, 268

(56) References Cited

U.S. PATENT DOCUMENTS

| | | | | | |
|---|---|---|---|---|---|
| 2,602,299 | A | * | 7/1952 | Sonderegger | 405/150.1 |
| 3,545,213 | A | * | 12/1970 | Sebor et al. | 405/150.2 |
| 3,698,066 | A | * | 10/1972 | Cornwell | 29/458 |
| 3,858,400 | A | * | 1/1975 | Bernold | 405/150.2 |
| 4,129,991 | A | * | 12/1978 | Schaden | 405/150.1 |
| 4,695,188 | A | | 9/1987 | Pulkkinen | 405/150 |
| 5,716,711 | A | | 2/1998 | Calder et al. | 428/425.5 |
| 6,193,439 | B1 | * | 2/2001 | Wolfseher | 405/150.2 |

FOREIGN PATENT DOCUMENTS

| | | |
|---|---|---|
| CH | 681475 A5 | 4/1990 |
| DE | 31 27 453 A1 | 2/1983 |
| DE | 32 44 000 A1 | 5/1984 |
| DE | 37 41 699 A1 | 6/1989 |
| FR | 2607534 | 6/1988 |
| WO | 0 007 413 A1 | 2/1980 |
| WO | WO87/04756 | 8/1987 |
| WO | WO97/25484 | 7/1997 |
| WO | WO98/24738 | 6/1998 |
| WO | 0 898 052 A1 | 2/1999 |

OTHER PUBLICATIONS

Patent Abstracts of Japan, vol. 1995, No. u, Aug. 31, 1995 & JP 07 097900 A, Apr. 11, 1995.
English–language abstract of FR 2607534, EP 0898052, DE 3244000A1, CH 681475, DE 3127453, DE 3741699.

* cited by examiner

*Primary Examiner*—Heather Shackelford
*Assistant Examiner*—Sunil Singh
(74) *Attorney, Agent, or Firm*—Norris McLaughlin & Marcus PA

(57) ABSTRACT

A cladding for a partially-overhanging substrate, such as a tunnel wall which comprises in sequence, from the tunnel wall, a drainage means, a sprayed polymeric membrane and a final layer of concrete. The cladding gives an effective cladding in conditions where the tunnel walls suffer from running water at the time of cladding, is easier to apply and requires less material.

35 Claims, 1 Drawing Sheet

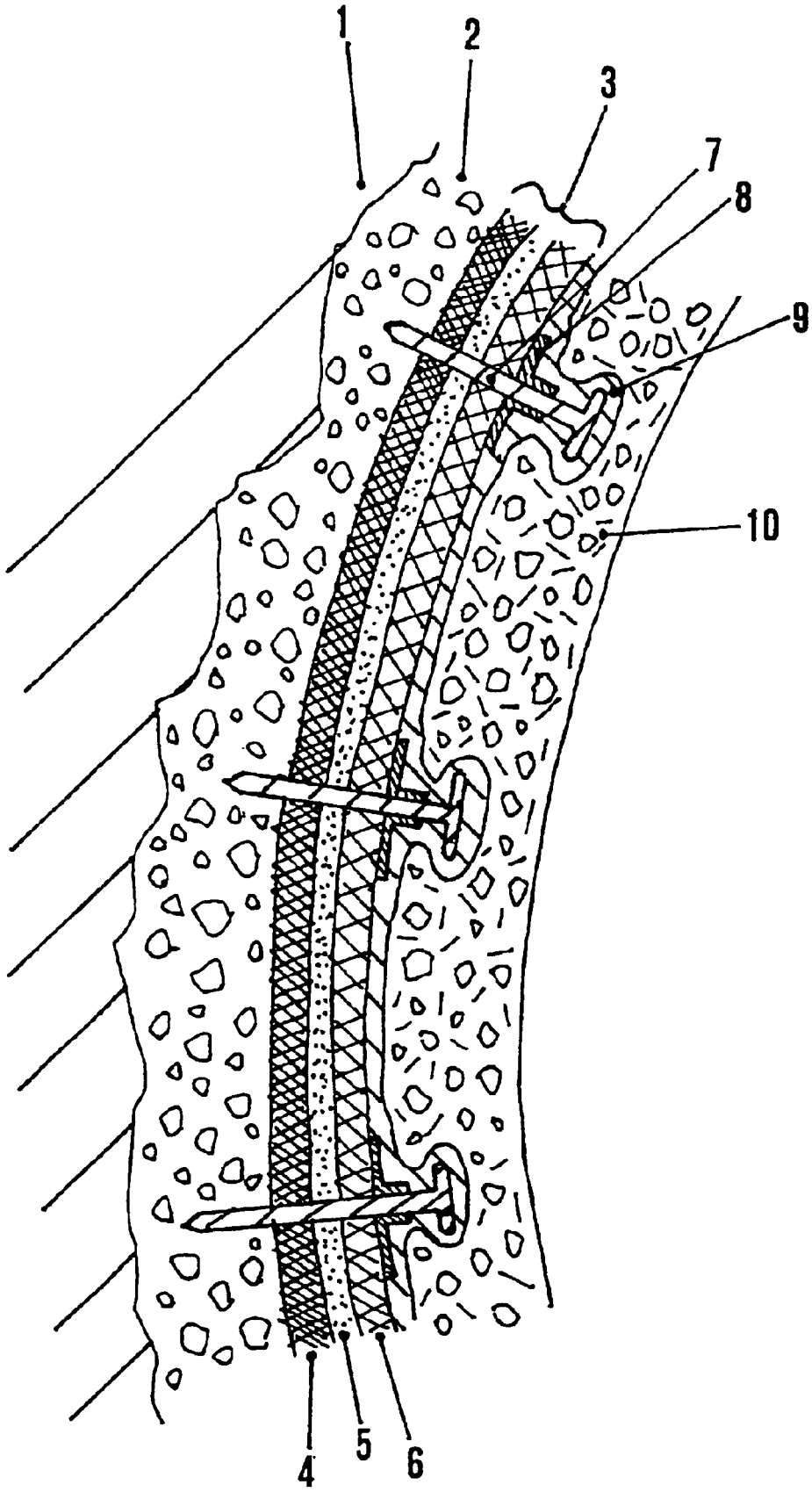
1
2
3
7
8
9
10
4
5
6

WATERPROOF CLADDING CONSTRUCTION AND METHOD OF PROVIDING THE SAME

This invention relates to the cladding of partially-overhanging substrates.

By "partially-overhanging substrates" is meant simply a substrate part of which overhangs. One example is a tunnel bored in rock, which has an overhanging roof and non-overhanging walls, but the substrate can equally well be a construction, for example, an arch of concrete, brick, stone or other material.

The exposed rock surfaces of tunnels often require cladding, this cladding generally being concrete, which may be sprayed (so-called "shotcrete"), cast in formwork or placed in prefabricated sections which are then grouted. One of the problems frequently encountered is water coming through and running down the substrate during the construction. The standard way of dealing with this problem is the application to the substrate of a drainage means. This is simply something which provides on the substrate a plurality of drainage channels, so that the water is directed away from the substrate to provided drainage outlets. The sequence therefore is usually as follows; apply a drainage means, followed by a waterproof membrane, followed by a final layer of concrete.

The drainage means known to the art can take various physical forms. One popular type comprises an open mesh made of plastics material, this being generally supplemented by an at least partially waterproof covering sheet to help direct the water to the provided drainage outlets and prevent it, in the case of high water flow, from running straight through. Another common type is a sheet of plastics material (typically of PVC or PE) which provides drainage channels. In one such material, the sheet comprises grooves through which water can run. In another variant, there is formed on the sheet a series of depressions which appear as protrusions on the other side of the sheet. These protrusions hold the sheet off the substrate and allow water drainage. Such drainage means are fixed to the substrate by any convenient means (adhesive, nails, rock anchors). To this drainage means is usually attached a waterproof membrane. This is generally a series of overlapping sheets of thermoplastic material which is applied to the drainage means and secured in place by melting the sheet around bolts previously applied through the drainage means into the rock for this purpose, the sheets then being joined by welding to form a single waterproof sheet. A final layer of concrete is applied to them by any of the methods hereinabove described.

In practice, this method suffers from a variety of drawbacks. It is difficult to weld the thermoplastic sheets together with complete success, so that there can be imperfect joins where water can come through. Moreover, such sheets may be damaged in handling and application and consequently suffer from leaks. In any case, the work of applying such sheets is time-consuming and difficult in a tunnel, as is the work of erecting the drainage means itself. In all cases, where other fixtures such as railway catenary supports are required, either these have to be driven through the drainage means into the rock (thereby providing a potential point of water entry), or the final concrete layer must itself be strong enough to support them, which usually means using a thickness of concrete not otherwise required.

It has now been found that such water problems can be substantially or even completely overcome by a particular structure. This invention therefore provides a cladding on a partially-overhanging substrate which comprises, in sequence starting from the substrate;

(i) a drainage means;

(iii) a waterproofing membrane which has been applied thereto by spraying; and (iv) a layer of concrete.

The invention further provides a method of providing a waterproof cladding on a partially-overhanging substrate, comprising the application to the substrate of the following elements in sequence;

(i) a drainage means;

(iii) a waterproofing membrane, applied by spraying; and (iv) a layer of concrete.

In a preferred embodiment of the invention, the substrate is given an initial layer of concrete. This is especially important when the substrate is rough, for example, as a result of blasting, and it preferably applied by means of spraying. Although it can also be done by casting or placing of prefabricated sections, shotcreting has the advantage that it conforms more exactly to the wall while providing a desirable smoother surface for the fixing of drainage means. This makes the final cladding essentially a single unit with the wall, enhancing its strength and making possible a cladding with substantially less material than formerly used.

The drainage means may be selected from any of the means of this type known to the art. A typical example is a plastics mesh to which is applied (to that side remote from the substrate) an at least partially waterproof layer. A particularly good variety of this type is a mesh to which is fixed a thin plastics impermeable sheet, on the other side of which sheet is a fibrous layer which assists in the bonding of the waterproofing membrane hereinunder described. However, there are many other types possible, and any of the art-recognised types are acceptable.

A preferred drainage means consists of two layers of "geotextile", fibrous materials of the type hereinabove described, between which is a waterproof film. Preferably the geotextile against the rock is hydrophobic and that further removed from the rock is hydrophilic. The hydrophobic layer helps repel water and the hydrophilic layer allows a water-based sprayable membrane to penetrate well and bond thoroughly as further described hereinunder, thus helping create a composite structure. This means is supplied as a single material, a so-called "drainage fleece". Any kind of sprayable membrane is useful in the working of this invention.

One particularly useful type of sprayable membrane is the membrane described in International Application WO 97/25484 the contents of which are incorporated herein by reference. In this case, it is a plastics material applied by spraying (a thermosetting polyurethane is described), the surface of this layer being configured in order to provide anchoring means for subsequently applied layers. This is done typically by mechanically deforming the surface before it hardens fully, or by embedding therein solid material such as stone chips.

Another particularly useful type of sprayable membrane is described in International Application WO 98/24738, the contents of which are incorporated herein be reference. In this case, the membrane is formed from a layer of coalesced particles of thermoplastic polymer laid down form an aqueous dispersion. Polyurethanes, polyesters and vinyls may be used, but the preferred materials are addition polymers of ethylenically-unsaturated monomers, more preferably, those having a glass transition temperature (Tg) of below 15° C., even more preferably below −15° C.

The weight solids contents of the aqueous dispersions from which the membranes are formed typically lie within the range of 30–60%. Specific examples of suitable materials include polyurethanes, styrene-butadiene copolymers, ABS (acrylonitrile-butadiene-styrene) polymers, acrylonitrile-butadiene copolymers, styrene-acrylic copolymers, polsulphide dispersions, polyurethane-acrylic dispersions, polyisoprene and PVC latexes and copolymers of vinyl chloride and/or vinyl acetate with acrylic monomers such as (meth)acrylic acid and esters thereof. Materials such as bitumen emulsions may be used in conjunction with these materials, but as such materials do not coalesce, they should not comprise more than 50% by weight solids of the binder. This list is not exhaustive, and the skilled person equipped within the concept of this invention will readily be able to identify other suitable materials. Many such materials are available commercially and examples of suitable commercial materials include those sold by BASF AG under the mark "Acronal" and those sold by Synthomer under the trade mark "Synthomer".

In addition to the aqueous dispersion, the composition may include other ingredients. One especially useful ingredient is filler. This not only "extends" the composition, but also roughens the surface, thus providing a "key" for a subsequently applied cementitious composition. Its presence is preferred. Typical examples of suitable fillers include quartz sand and quartz flour of average diameters in the range of from 0.04–1.5 mm, as well as dolomite, talc, mica, barytes, iron oxide, titanium dioxide, rubber and plastics granules, lightweighted aggregates and glassy furnace residues such as "holospheres". Fibres of steel, glass or polymeric material can also be used, preferred examples of polymeric fibre being those of thermoplastic material, especially polyethylene and polyacrylonitrile, preferably with lengths of from 0.2–12 mm and surface area of from 6–8 $m^2/g$.

Sprayable membranes confer good waterproofness, but cannot be used on a substrate on which there is running water. The combination of drainage means and waterproofing membranes overcomes this difficulty and gives an especially versatile and high-performing system. This is largely because the two components, drainage means and sprayable membrane, become in effect a single composite entity. The invention therefore also provides a composite waterproofing system for application to surfaces, consisting of a drainage means as hereinabove defined and a sprayed waterproof membrane. In addition, fixtures can be added before the membrane spraying and the subsequent membrane spraying will ensure that the penetration of the fixture through the drainage means remains watertight. This means that a subsequent layer of concrete need not be load-bearing and therefore can be much thinner than would otherwise be the case.

To the surface of the membrane is applied a layer of concrete. This can be done by any convenient means, but ideally by spraying. Spraying brings many advantages. For example, the layer conforms with the membrane and forms with it, the drainage means, the substrate and, if applied, any initial concrete layer a single composite entity, thus enhancing the benefits of the composite waterproofing system hereinabove described. This is very strong and reduces substantially the quantities of concrete needed. For example, using prior art-recognised methods, a final concrete layer would need to be typically 25 cm. thick. When this invention is used, a layer may be as low as 5 cm. thick, representing a significant saving in time, money and material. In addition, application methods such as casting require not only complex formwork, but also reinforcing grids. The sprayed concrete does not need this, it being possible, if desired, to provide fibre reinforcement in the concrete mix itself by the inclusion of fibres.

A further important characteristic is that the continuous bond between the sprayed membrane and the final shotcrete layer prevents what often happens on sheet-based systems, namely the movement of water along the membrane-shotcrete interface from the point of actual leakage and its eventual appearance tens of metres from that point. In the system of the present invention, any leakage will take place at the point of leakage itself, and can be easily repaired.

The invention is useful primarily in tunnelling, but it may also be used in free-standing completely artificial structures which comprise partial overhangs of the type hereinabove described, for example, arches of concrete, brick, stone or other such material. In comparison with the art-recognised methods, it is simpler to use, it provides better results and it requires less material and time.

BRIEF DESCRIPTION OF THE DRAWINGS

The drawing depicts a cross-sectional view of a preferred embodiments of the invention.

The invention will now be described with reference to the accompanying drawing which depicts a schematic cross-sectional view of a preferred embodiment. In this drawing, the dimensions of some elements have been exaggerated to make clear the nature of the construction.

In the drawing, the invention has been applied to a rock wall 1 of a bored tunnel. To this rock wall is applied an initial layer of shotcrete 2. To this is then applied a drainage fleece, generally designated as 3. This drainage means consists of three elements, a fibrous, hydrophobic sheet 4, a waterproof film 5 and a fibrous hydrophilic sheet 6, the three being combined in a single sheet and secured to the shotcrete layer 2 by means of nails 7 whose heads protrude slightly from the drainage means. The nails additionally comprise fleece retaining means 8, preferably of plastics material, which comprise shanks which are a tight fit on the nails 7 and comparatively large roundels which press the fleece against shotcrete layer 2. The fibrous sheet 6 and the nail heads help a subsequent sprayed membrane 9 to bond more securely to the drainage means.

To the drainage means is applied by spraying a waterproofing membrane 9, the composition of which is

| | |
|---|---|
| polymer dispersion[1] | 30 parts by weight |
| barytes | 27 parts by weight |
| calcium carbonate | 42.5 parts by weight |
| titanium dioxide | 0.5 parts by weight |

[1]styrene-acrylc ester copolymer emulsion 50% solids by weight ("Acronal") (trade mark) S361 (ex BASF))

This corresponds to Example 1 of WO 98/24738.

Finally, a layer of reinforcing fibre-containing shotcrete 10 is applied.

The shotcrete formulation useful in this application may be any such formulation useful in such an application. In addition, the skilled person will readily appreciate that there are possible many variations in both materials and methods which fall within the scope of the invention. For example, should enhanced load-bearing strength be needed, the nails 7, depicted in the drawing as being covered by the sprayed membrane 9, may protrude through it and into the shotcrete layer 10. The nail heads provide a "key" which supplements the excellent bonding of the shotcrete to the membrane.

In another embodiment, the hydrophobic fibrous sheet may be replaced by a plastics grid which has the form of two parallel sets of elongate intersecting elements, one set resting on the surface of shotcrete layer 2 and spacing the other set from it, thus defining a plurality of drainage channels. The waterproof plastics sheet 5 is advantageously of the same plastics material.

What is claimed is:

1. A cladding on a partially-overhanging substrate which comprises, from the partially-overhanging substrate inward toward the interior of the cladding the following elements:

(a) a drainage means selected from the group consisting of:

(i) a plastics mesh to which is applied to that side remote from the substrate an at least partially waterproof layer; and (i) two layers of geotextile wherein a waterproof film is between the two layers of geotextile;

(b) a sprayable waterproofing membrane; and (c) a layer of concrete;

wherein there is optionally a layer of concrete between the partially-overhanging substrate and the drainage means (a).

2. A cladding according to claim 1, wherein there is a layer of concrete between the partial-overhanging substrate and the drainage means (a).

3. A cladding according to claim 1 wherein the drainage means is a plastics mesh.

4. A cladding according to claim 1 wherein the waterproofing membrane is a plastics material applied by spraying.

5. A cladding according to claim 1 wherein the waterproofing membrane is a layer of coalesced particles of thermoplastic polymer formed from a sprayed aqueous dispersion.

6. A cladding according to claim 1 wherein the layer of concrete (c) is applied by spraying.

7. A cladding according to claim 6, wherein the sprayed concrete comprises reinforcing fibres.

8. A cladding according to claim 1, which further comprises a fastening means used to secure said waterproofing membrane to said drainage means.

9. The cladding of claim 1, wherein the drainage means is two layers of geotextile wherein a waterproof film is between the two layers of geotextile wherein the geotextile layer closer to the overhanging substrate is hydrophobic and the geotextile layer closer to the waterproof membrane is hydrophilic.

10. The cladding of claim 9, wherein the hydrophobic geotextile layer is a fibrous hydrophobic sheet and the hydrophilic geotextile layer is a fibrous hydrophilic sheet.

11. The cladding of claim 1, wherein the drainage means is secured by nail wherein the nail head of said nails protrudes from the drainage means into the waterproofing membrane.

12. The cladding of claim 11, wherein the drainage means further comprises a drainage means retaining means which comprise of shanks which fit around said nails.

13. The cladding of claim 1, wherein in the layer of concrete (c) is a reinforcing fiber-containing shotcrete.

14. A method of providing a waterproof cladding on a partially-overhanging substrate, comprising the application to the substrate the following elements in sequence:

a drainage means selected from the group consisting of;

(i) a plastics mesh; and ii) two layers of geotextile wherein a waterproof film is between the two layers of geotextile;

a waterproofing membrane, applied by spraying; and a layer of concrete.

15. A method of providing a waterproof cladding on a partially-overhanging substrate according to claim 14, wherein the substrate is given an initial layer of concrete.

16. A method of providing a waterproof cladding on a partially-overhanging substrate according to claim 14, wherein the drainage means is a plastics mesh to that side of which remote from the substrate is applied on at least partially waterproof layer.

17. A method of providing a waterproof cladding on a partially-overhanging substrate according to claim 14, wherein the waterproofing membrane is a sprayed plastics material having a surface configured so that the anchoring means for subsequently-applied layers is provided.

18. A method of providing a waterproof cladding on a partially-overhanging substrate according to claim 14, wherein the waterproofing membrane is a layer of coalesced particles of thermoplastic polymer formed from a sprayed aqueous dispersion.

19. A method of providing a waterproof cladding on a partially-overhanging substrate according to claim 14, wherein the layer of concrete is applied by spraying.

20. A method of providing a waterproof cladding on a partially-overhanging substrate according to claim 14, wherein the concrete comprises reinforcing fibres.

21. A method of providing a waterproof cladding on a partially-overhanging substrate according to claim 14, which further comprises the step of securing said waterproofing membrane to said drainage means by a fastening means.

22. A cladding on a partially-overhanging substrate which comprises, in sequence starting from the substrate;

a drainage means, wherein the drainage means is a plastics mesh;

a waterproofing membrane which has been applied thereto by spraying; and a layer of concrete.

23. A cladding according to claim 22, wherein the substrate is given an initial layer of concrete.

24. A cladding according to claim 22 wherein the waterproofing membrane is a plastics material applied by spraying and whose surface is configured so that anchoring means for subsequently-applied layers is provided.

25. A cladding according to claim 22 wherein the waterproofing membrane is a layer of coalesced particles of thermoplastic polymer formed from a sprayed aqueous dispersion.

26. A cladding according to claim 22 wherein the layer of concrete is applied by spraying.

27. A cladding according to claim 26, wherein the layer of concrete is applied by spraying comprises reinforcing fibres.

28. A cladding according to claim 22, which further comprises a fastening means used to secure said waterproofing membrane to said drainage means.

29. A method of providing a waterproof cladding on a partially-overhanging substrate, comprising the application to the substrate the following elements in sequence:

a drainage means, wherein the drainage means is a plastics mesh to that side of which remote from the substrate is applied on at least partially waterproof layer a waterproofing membrane, applied by spraying; and a layer of concrete.

30. A method of providing a waterproof cladding on a partially-overhanging substrate according to claim 29, wherein the substrate is given an initial layer of concrete.

31. A method of providing a waterproof cladding on a partially-overhanging substrate according to claim 29, wherein the waterproofing membrane is a sprayed plastics material having a surface configured so that anchoring means for subsequently-applied layers is provided.

32. A method of providing a waterproof cladding on a partially-overhanging substrate according to claim 29, wherein the waterproofing membrane is a layer of coalesced particles of thermoplastic polymer formed from a sprayed aqueous dispersion.

33. A method of providing a waterproof cladding on a partially-overhanging substrate according to claim 29, wherein the layer of concrete is applied by spraying.

34. A method of providing a waterproof cladding on a partially-overhanging substrate according to claim 29, wherein the concrete comprises reinforcing fibres.

35. A method of providing a waterproof cladding on a partially-overhanging substrate according to claim 29, which further comprises the step of securing said waterproofing membrane to said drainage means by a fastening means.

* * * * *